United States Patent [19]

Beales et al.

[11] Patent Number: 5,060,804

[45] Date of Patent: Oct. 29, 1991

[54] GABLE TOP CARTON WRAPPER

[75] Inventors: Jonathan T. Beales, Memphis, Tenn.; Paul D. Richardson, Cincinnati, Ohio

[73] Assignee: International Paper Company, Purchase, N.Y.

[21] Appl. No.: 691,249

[22] Filed: Mar. 25, 1991

[51] Int. Cl.[5] ..... B65D 5/54

[52] U.S. Cl. ..... 206/611; 206/831; 229/103.1; 229/40

[58] Field of Search ..... 229/40, 103.1; 206/605, 206/608, 611, 427, 831

[56] References Cited

U.S. PATENT DOCUMENTS

| | | | |
|---|---|---|---|
| 885,565 | 4/1908 | Batten . | |
| 2,103,386 | 5/1935 | Salfisberg | 206/46 |
| 3,258,385 | 11/1961 | Lake | 156/581 |
| 3,047,942 | 8/1962 | Schneider et al. | 29/470 |
| 3,109,764 | 11/1963 | Natelli | 156/582 |
| 3,167,214 | 1/1965 | Mahon | 229/40 |
| 3,468,731 | 9/1969 | Obeda | 156/73 |
| 3,670,879 | 6/1972 | Williard et al. | 229/40 |
| 3,750,926 | 8/1973 | Sakamoto et al. | 228/1 |
| 3,947,307 | 3/1976 | Buchscheidt | 156/73.1 |
| 4,042,110 | 8/1977 | Guernsey | 206/831 |
| 4,063,990 | 12/1977 | Volz | 156/580 |
| 4,131,505 | 12/1978 | Davis | 156/580.1 |
| 4,167,092 | 9/1979 | Medwed | 53/373 |
| 4,202,446 | 5/1980 | Sutherland | 229/40 |
| 4,382,505 | 5/1983 | Sutherland et al. | 206/427 |
| 4,411,720 | 10/1983 | Sager | 156/69 |
| 4,440,340 | 4/1984 | Bakx | 206/427 |
| 4,586,317 | 5/1986 | Bussell | 53/451 |
| 4,588,084 | 5/1986 | Holley, Jr. | 206/427 |
| 4,696,402 | 9/1987 | Harmon et al. | 206/611 |
| 4,746,025 | 5/1988 | Krautkramer et al. | 215/232 |
| 4,767,492 | 8/1988 | Fukusima et al. | 156/580.2 |
| 4,769,095 | 9/1988 | Sager | 156/69 |
| 4,909,434 | 3/1990 | Jones et al. | 229/125.15 |
| 4,925,019 | 5/1990 | Ganz et al. | 206/427 |

FOREIGN PATENT DOCUMENTS

| | | | |
|---|---|---|---|
| 79167 | 9/1962 | France | 206/602 |
| 2452440 | 11/1980 | France | 229/103.1 |

*Primary Examiner*—Gary E. Elkins

*Attorney, Agent, or Firm*—Michael J. Doyle; Walt Thomas Zielinski

[57] ABSTRACT

A wrap-around carrier to package a linear series of gable-top liquid cartons is formed from a one piece paperboard blank conformed so that an end flap will cover a major area of an end of the erected carrier to inhibit damage, loss, or pilferage of an object such as a straw temporarily secured to an otherwise exposed side of a contained carton.

The top panel is provided with a longitudinally running tear strip, conveniently wide enough to form a returnable card or a coupon, the coupon provided with advertising or other indicia on one or both of its surfaces.

8 Claims, 2 Drawing Sheets

FIG. 1
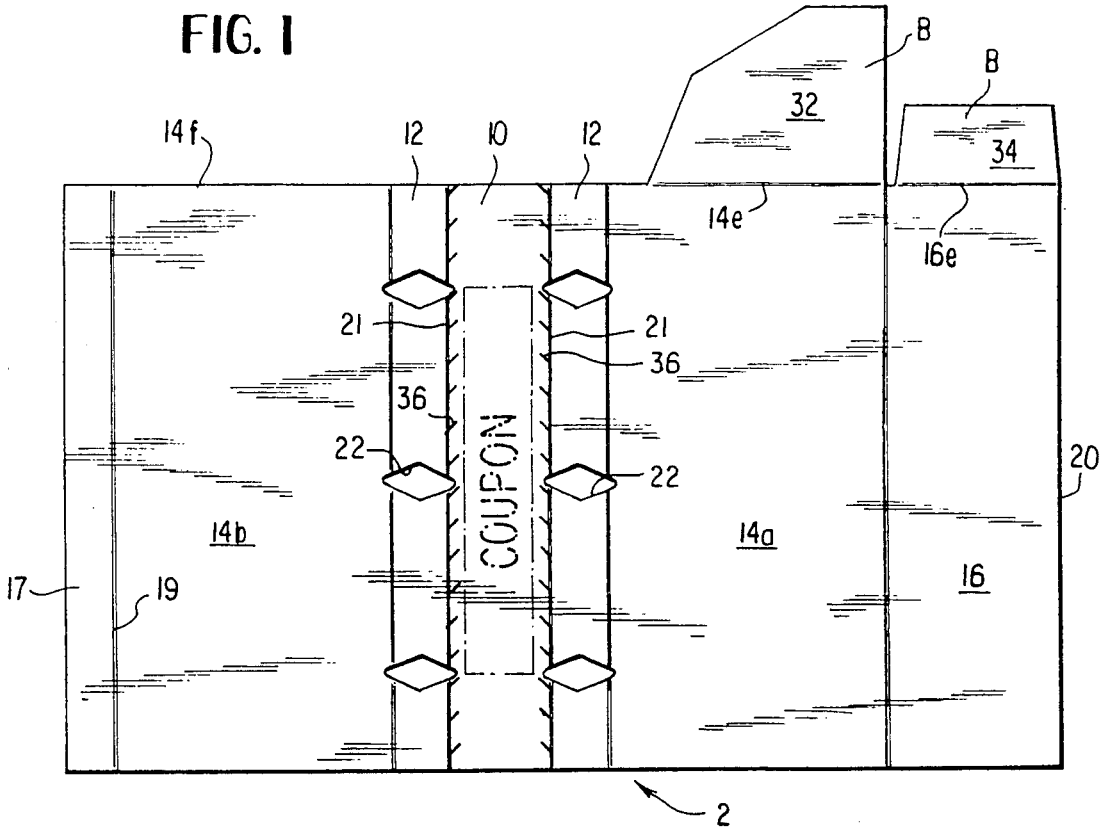
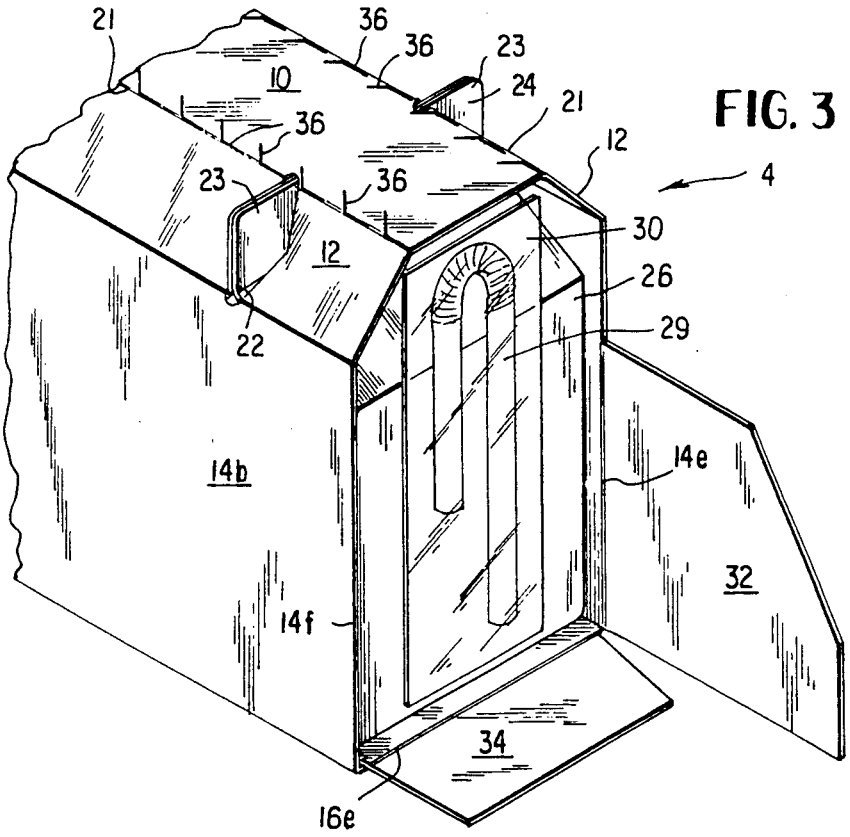
FIG. 3

GABLE TOP CARTON WRAPPER

BACKGROUND OF THE INVENTION

This invention relates to the packaging of containers by a wrapper (wrap-around carrier), the containers being of the well known gable-top type.

One improved manner to sell individual portion size gable-top paperboard cartons of soft drinks is to package them in multiple packages of the beverage-filled cartons contained in wrap-around carriers. For instance, a linear series of three such gable-top liquid cartons may be secured in a generally open-ended, wrap-around carrier, each with a small plastic drinking straw temporarily secured as by glue to one of its sides. This means that a carton on one end of the packaged series will have exposed to the open end of the carrier its removable straw which is therefore subject to damage, loss, or pilferage during transportation and on the shelf of a retail store.

It is therefore desirable to provide to the packager for the benefit of the ultimate consumer an economical one-piece paperboard blank for forming such a wrap-around carrier which includes a feature for protection against such damage, loss, and pilferage.

One of the conventional forms of wrap-around carriers for gable-top cartons has a top panel portion extending the full length of the carrier and having a substantial area. This means that there is ample room on its surface for advertising and coupon-type printed indicia. And if this top panel portion could be readily removed by the ultimate customer, it could be retained and returned as a card to the store as a repurchase type coupon. Furthermore, the under or inside surface portion of the top panel portion could be so imprinted, for instance, for exposure only after removal.

And if the top panel can be easily removed by the final customer, it will thus serve as a tear strip for opening the carrier.

It is the broad object of this invention to incorporate the above described desirable features in a unitary blank and a carrier formed from such blank with an economy of material which can be processed in standard packaging equipment and process.

SUMMARY OF THE INVENTION

The invention provides a one-piece paperboard blank for forming a wrap-around carrier to package a linear series of gable-top liquid cartons, each typically of an individual portion size and provided with a drinking straw temporarily secured to a normally vertical side of the carton. To provide protection against damage, loss, and pilferage of the attached straw or other item, such perhaps as a favor, the blank has a substantially large flap foldably attached at what will be the end of the erected carrier so as to cover a substantial area of the otherwise open end. Another end flap is attached to the blank to secure the large flap in place as by gluing in the erected container.

Because of the relative sizes of the areas of the parts, it has been found preferable to attach the larger flap to one of the side wall panel portions of the blank and the smaller to the bottom panel portion but the positions of these flaps may be reversed or otherwise rearranged if desired.

The top panel portion has score lines along its longitudinal edges rendering its relatively easy removal by the ultimate customer to obtain access to the contained cartons. Either or both of the intended upper and lower surfaces of the top panel portion may be imprinted with suitable indicia so that after the top is removed from the erected carrier it may serve as a coupon for return to the store.

DESCRIPTION OF THE DRAWINGS

FIG. 1 is a layout or plan view of the one piece blank of the invention.

FIG. 3 is a partial perspective view somewhat similar to FIG. 2, showing the partially erected carrier before the protective end flaps are closed and secured.

DETAILED DESCRIPTION OF THE INVENTION

Figure 2:
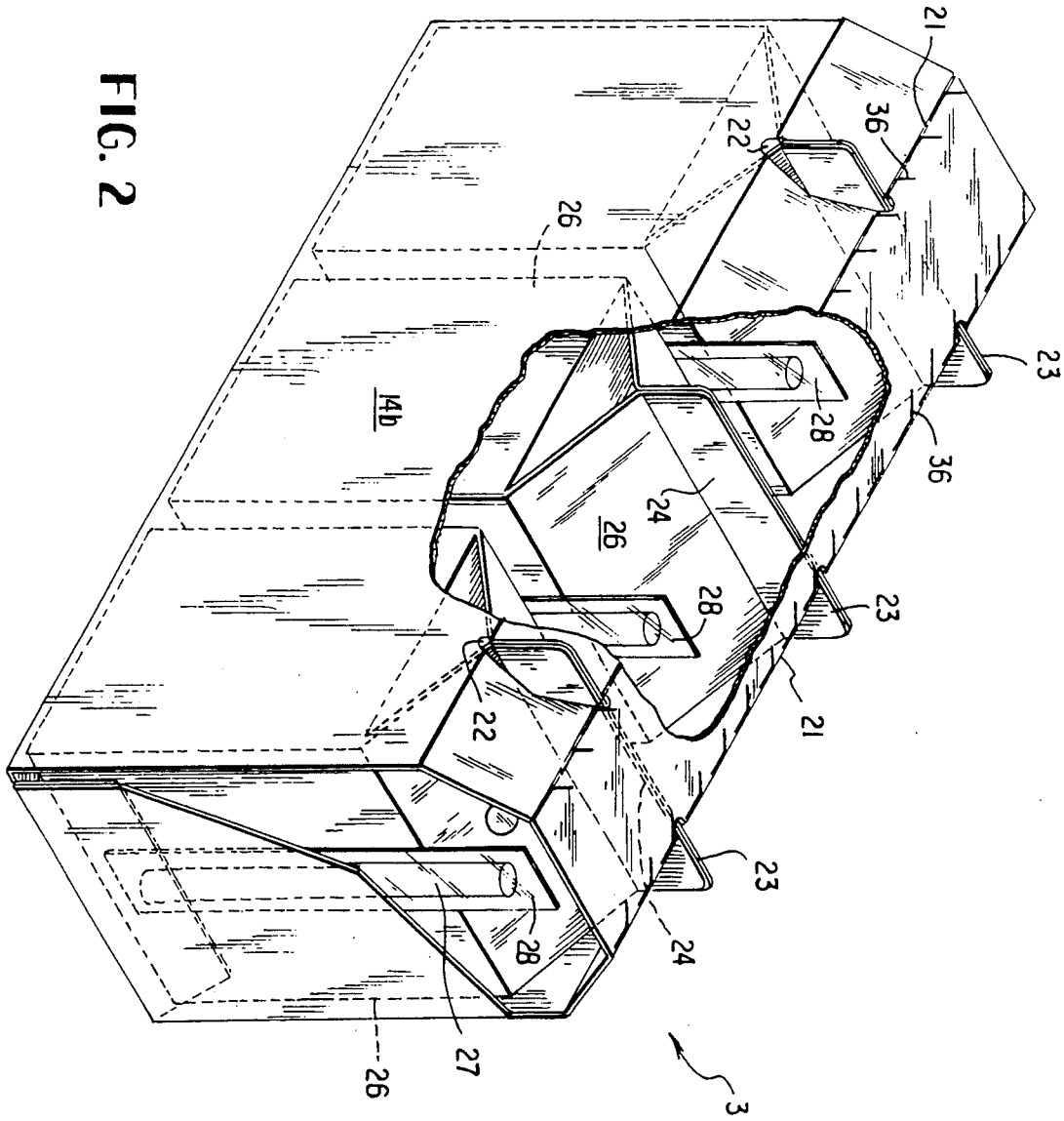
FIG. 2 is a perspective view of the blank of the invention erected into the wrap-around carrier with its three contained gable-top soft drink cartons, partly broken away for clarity and particularly showing the end protecting the temporarily attached drinking straw.

The paperboard blank of the invention laid flat out is indicated at 2 in FIG. 1, at 3 in FIG. 2 in the erected carrier from which it is made, and at 4 as partially erected in FIG. 3. The blank has a top panel portion 10, top corner panel portions 12, side wall panel portions 14*a* and 14*b*, and a bottom panel portion 16. A glue tab 17 is foldably attached to the outside longitudinal edge 19 of the side wall 14*b* but could alternatively be attached to the outer longitudinal edge 20 of the bottom panel 16. The top corner panel portions lo along the latter's longitudinal edges 21 and have oppositely disposed openings 22 to securely receive portions 23 of the top opening tabs 24 of contained cartons 26. Each of the cartons 26 will have a straight telescoping type straw 27 encased in a cellophane envelope 28 lightly glued to one of its sides as seen in FIG. 2 or perhaps a folding type straw 29 encased in its cellophane envelope 30 glued to a side of the carton 26 as seen in FIG. 3 or even some other object such as a gift favor. The blank is typically of paperboard or other stiff, foldable and resilient sheet material.

Straws 27 and 29 or other types of temporary attachments are subject to damage, loss, or pilferage at one end of the erected carrier as best seen in FIG. 3 unless protected from these dangers.

As seen in FIG. 1, a first end flap 32 is foldably attached to an end 14*e* of the side wall 14*a*. As seen in FIGS. 2 and 3, such flap 32 is sufficiently large to cover the major area of the open end of the carrier 3, 4 when in erected condition, thereby to inhibit such pilferage, loss, or damage.

A second end flap 34 attached to an end 16*e* of the bottom panel portion 16 adjacent to the end flap 32 in order to secure the latter in position as by gluing when the blank 2 is erected as a carrier 4 as best seen in FIG. 2.

In an alternative embodiment, not shown, the large protective end flap 32 could be attached to the bottom panel 16 and the smaller end flap to secure it could be attached to a corresponding end of one of the side wall portions 14*a*, depending upon the relative dimensions of the parts of the containers to be contained in the carrier. In another alternative embodiment the second end flap 34 could be attached to a corresponding end 14*f* of the side wall 14*b*.

As seen in the drawings, the top panel portion 10 is arranged to function as a tear strip by score lines 36 along its foldable edges 21.

The top panel portion 10 is also made wide enough to accommodate coupon-type indicia imprinted on one or the other of its surfaces, as indicated by the work "COUPON" in FIG. 1. Thus this arrangement provides not only an easily removable tear strip for access to the interior of the carrier package but also a readily returnable coupon which, as an advertising and sales gimmick, can be imprinted on the bottom surface of the top panel portion at least in part so as to be invisible until removed from the package.

We claim:

1. A one piece paperboard blank (2) for a wrap-around carrier to package a linear series of gable-top liquid cartons, said blank comprising:

(a) a top panel portion (10), (b) top corner panel portions (12) foldably attached to longitudinal edges (21) of the top panel portion and having oppositely disposed openings (22) to securely receive portions (23) of the top opening tabs (24) of contained said cartons (26), (c) side wall panel portions (14*a*, 14*b*) foldably attached to the top corner panel portions, (d) a bottom panel portion (16) foldably attached to one said side wall panel portion, (e) a first end flap (32) foldably attached to one of the said side wall and bottom panel portions and of a size sufficient to cover the major area of an end of said carrier when in erected condition thereby to inhibit pilferage of an object (27, 29) temporarily secured to an exposed side of a said contained carton, and (f) a second end flap (34) foldably attached to another of the said side wall and bottom panel portions so as to secure said first end flap in position when the blank is erected as a carrier.

2. The blank as set forth in claim 1 wherein said top panel portion has score lines (36) along its foldable edges thereby providing an easily removable tear strip for access to the interior of the said carrier.

3. The blank as set forth in claim 2 wherein the said top panel portion has graphic indicia imprinted on one of its surfaces.

4. A one piece paperboard blank for a wrap-around carrier to package a linear series of gable-top liquid cartons, said blank comprising:

(a) a top panel portion, (b) top corner panel portions foldably attached to longitudinal edges of the top panel portion and having oppositely disposed openings to securely receive portions of the top opening tabs of contained said cartons, (c) side wall panel portions foldably attached to the top corner panel portions, (d) a bottom panel portion foldably attached to one said side wall panel portion (14*a*), (e) a first end flap (32) foldably attached to the same one said side wall panel portion (14*a*) and of a size sufficient to cover the major area of an end of said carrier when in erected condition thereby to inhibit pilferage of an object temporarily secured to an exposed side of a said contained carton, and (f) a second end flap (34) foldably attached to said bottom panel portion (16) and located adjacent to said first end flap (32) so as to secure it in position when the blank is erected as a carrier.

5. A one piece paperboard blank for a wrap-around carrier to package a linear series of gable-top liquid carriers, said blank comprising:

(a) a top panel portion, (b) top corner panel portions foldably attached to longitudinal edges of the top panel portion and having oppositely disposed openings to securely receive portions of the top opening tabs of contained said cartons, (c) side wall panel portions foldably attached to the top corner panel portions, a bottom panel portion foldably attached to one said side wall, and (d) said top panel portion having score lines along its foldable edges and imprinted coupon type indicia on one of its surfaces thereby providing an easily removable tear strip for access to the interior of the said carrier also serving as a readily returnable coupon.

6. A wrap-around carrier package including a wrap-around carrier (4) formed from a unitary blank (2) of paperboard, the carrier folded and glued to a tube-like structure, the carrier having a bottom panel (16) and two upstanding side wall panels (14*a*, 14*b*), said side wall panels respectively foldably attached to top corner panel portions (12), the latter foldably secured to a top panel portion (10) along longitudinal edges (21) of the top panel portion (10), the top corner panel portions (12) each having oppositely disposed openings (22) which receive top opening tabs (24) of a plurality of cartons (26) positioned in a row within the wrap-around carrier, one end of said tube-like structure being at least partially closed by an end flap (32, 34) foldably attached to one of said panel portions (14*a*, 14*b*, 16), that carton of said plurality of cartons (26) which is nearest said at least partially closed end having a drinking straw (27, 29) mounted thereon and in contact with said end flap (32, 34) to thereby inhibit pilferage and damage to the drinking straw (27, 29) prior to opening of the carrier.

7. The package of claim 6 including score lines (36) along said top panel portion (10), the score lines defining a tear strip to facilitate opening of the package.

8. The package of claim 6 wherein said end flap (32, 34) and another end flap (32, 34) also foldably attached to one of said panel portions (14*a*, 14*b*, 16) are secured together.

* * * * *